US005181559A

United States Patent [19]

Svoboda

[11] Patent Number: 5,181,559

[45] Date of Patent: Jan. 26, 1993

[54] WATER-COOLED CONDENSER

[75] Inventor: Vaclav Svoboda, Baden, Switzerland

[73] Assignee: Asea Brown Boveri Ltd., Baden, Switzerland

[21] Appl. No.: 797,899

[22] Filed: Nov. 26, 1991

[30] Foreign Application Priority Data

Dec. 5, 1990 [EP] European Pat. Off. ..... 90123310.6

[51] Int. Cl.[5] ..... F28F 19/02

[52] U.S. Cl. ..... 165/134.1; 165/133; 165/158

[58] Field of Search ..... 165/133, 134.1, 158, 165/173

[56] References Cited

U.S. PATENT DOCUMENTS

| | | | |
|---|---|---|---|
| 4,252,182 | 2/1981 | Fender | 165/134.1 |
| 4,562,887 | 1/1986 | Muri | 165/158 |
| 4,570,701 | 2/1986 | Roberts | 165/158 |
| 4,825,942 | 5/1989 | Helberg | 165/158 |

FOREIGN PATENT DOCUMENTS

| | | | |
|---|---|---|---|
| 0267349 | 5/1988 | European Pat. Off. . | |
| 0267350 | 5/1988 | European Pat. Off. . | |
| 538769 | 11/1931 | Fed. Rep. of Germany | 165/158 |
| 52-57556 | 5/1977 | Japan | 165/134.1 |

OTHER PUBLICATIONS

"Les echangeurs en acier plaque titane", L'Industrie du Petrole en Europe Gaz-Chimie, vol. 43, No. 466, Nov. 1975, pp. 25-27, P. Maugard, author.

*Primary Examiner*—Allen J. Flanigan
*Attorney, Agent, or Firm*—Burns, Doane, Swecker & Mathis

[57] ABSTRACT

In a water-cooled condenser, titanium condenser tubes are rolled and/or welded at each end into a tube plate. The titanium tube plates are bolted to the condenser casing and a header casing by means of flanges. The sheet steel condenser casing is provided, at the connection location with the tube plates, with explosion-bonded titanium plating which is welded in a watertight manner to the tube plates on the steam space side. The explosion-bonded titanium plating is applied to the steam space side part of the flange. The flange bolting arrangement is located outside the sealing surface between flange and tube plate.

1 Claim, 1 Drawing Sheet

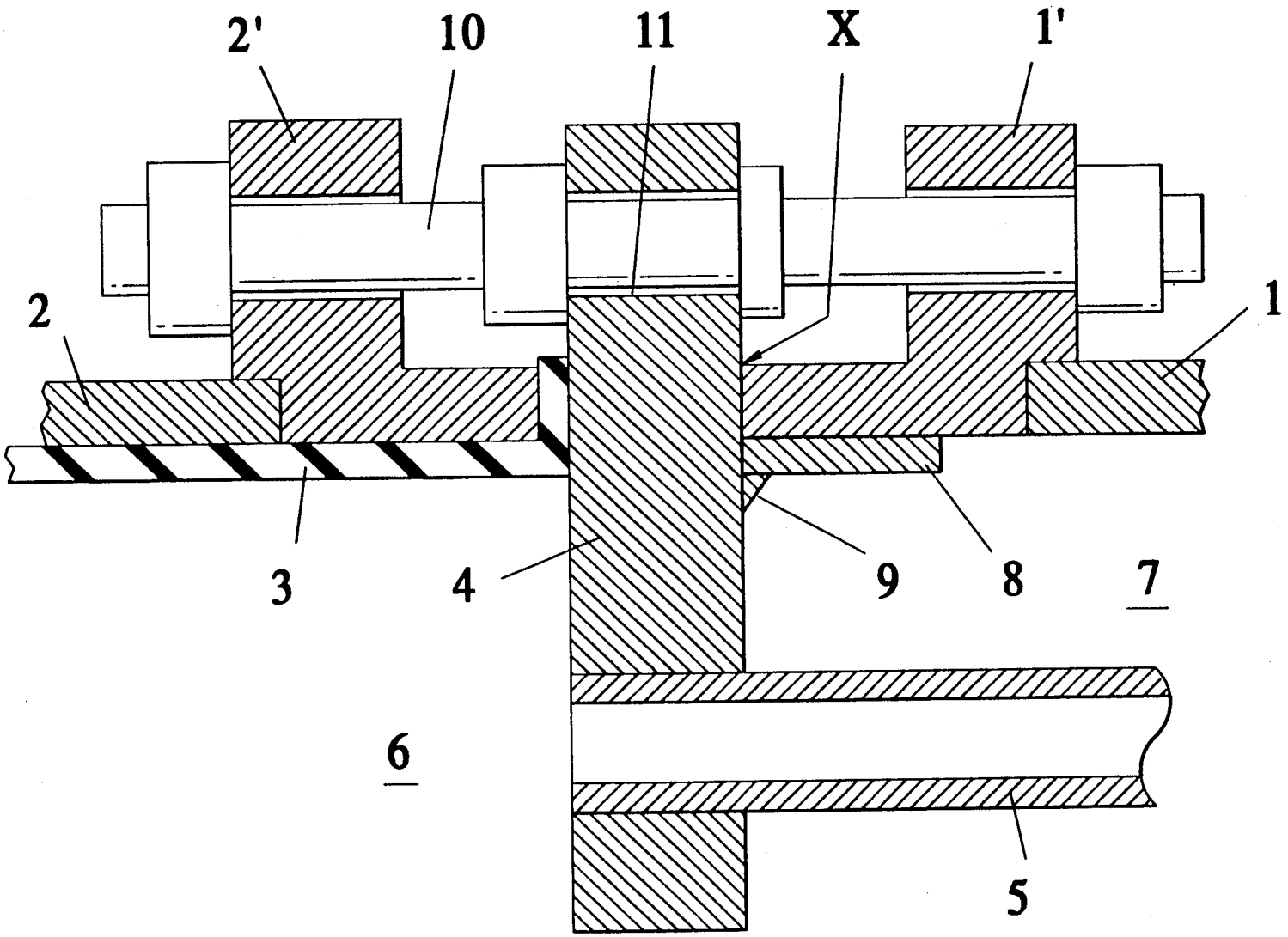
1
1'
X
11
10
2'
2
3
4
6
7
8
9
5

WATER-COOLED CONDENSER

BACKGROUND AND SUMMARY OF THE PREFERRED EMBODIMENT

The invention relates to a water-cooled condenser in which the titanium condenser tubes are rolled and/or welded into a tube plate at each end and in which the titanium tube plates are bolted to the condenser casing and the header casing by means of flanges, the condenser casing of sheet steel being provided with explosion-bonded titanium plating at the connection location to the tube plates, which explosion-bonded titanium plating is welded in a watertight manner to the tube plates on the steam space side.

Such condensers, which are located at the so-called cold end of heat engines and have, as their purpose, to provide a steam turbine, for example, with a larger pressure drop and heat drop by generating a maximum possible vacuum, are known. If, in these condensers, the headers are connected to the tube plates and the condenser shell by means of flanges, the following problems are prevalent:

- the machining of the extraordinarily large flanges for today's large condensers requires great effort on site;
- the danger fundamentally exists that air can penetrate into the steam space of the condenser because of the large flanges;
- leaking flanges can only be sealed subsequently in a very makeshift manner and with difficulty.

Power station operators now demand an extremely high level of sealing against cooling water penetration into the condensers. The permissible leakage rates are scarcely measurable and this leads to the previously used technique of rolling in the tubes being supplemented by welding in the tubes. In addition, extremely corrosion-resistant titanium tubes are now being used.

In the case of the flange connection described above, the possibility now also exists of rolling and/or welding the titanium tubes into titanium tube plates. This is particularly obvious because it is practically only possible to weld titanium to titanium. Appropriate seals must be provided for the bolting of the titanium tube plate to the flanges of both the header casing and the condenser casing. The rubber layer of the protective coating, which is necessary in any case, is therefore located between header casing and tube plate while a soft seal is inserted between tube plate and flange of the condenser casing. After a fairly long operating period, such a solution can, however, lead to penetration of both cooling water and air into the steam space because the seals are very heavily loaded due to the different expansions between the tubes and the condenser shell.

A water-cooled condenser with a steel condenser casing is known from U.S. Pat. No. 4,252,182, in which condenser titanium tubes penetrate a steel tube plate and are rolled into it; their ends are welded into a special titanium plate placed in front of the tube plate. The problems of the otherwise conventional tube/tube plate welded connection are solved by this configuration. The titanium plate itself is directly bolted to the header and is bolted to the tube plate via distance elements. The tube plate is also bolted to the condenser casing. Because, with this arrangement, a steel tube plate is to be connected to a steel condenser casing, no material technology difficulties arise even if, in the case shown, air penetration into the steam space of the condenser must possibly be expected because of the use of bolting alone.

Also known from U.S. Pat. No. 4,562,887 is a flange connection, of the type described above, in which the end surface of the flange to be bolted to the tube plate is provided with explosion plating. After the fitting of the tube plates to the condenser casing, this explosion plating is welded to the tube plates. Although, in this solution, the explosion plating is subjected exclusively to compression and can therefore not separate from the flange, the weld seam could be damaged for some reason and in this case, the possibility exists of air penetration and, in particular, of cooling water penetration via leaking protective coatings and the bolt holes.

The object of the invention is therefore to create, in a condenser of the type described above, a connection which can be inspected between the titanium tube plate and the steel sheet of the flange/condenser casing.

In accordance with the invention this object is achieved in that explosion-bonded titanium plating is applied to the steam space side part of the flange and that the flange bolting arrangement is located outside the sealing surface between the flange and the tube plate.

In addition to the fact that the critical point in flange designs is now provided with an absolutely leaktight welded connection, the advantage of the invention may be particularly seen in that even in the case of a leaking weld seam between the explosion plating and the tube plate, the sealing surface is accessible from outside for repair purposes.

BRIEF DESCRIPTION OF THE DRAWING

An illustrative example of the invention is shown diagrammatically in the drawing. The single FIGURE shows a partial longitudinal section of a flange connection between header, tube plate and condenser shell.

Elements which are unimportant to the invention, such as the design of the header and the tube inlets, are not shown although the corrosive effect of the cooling water is a boundary condition with respect to their design. The actual tube fastening and the bundle-type configuration of the tubes in the steam space are not shown either because they do not contribute to better understanding of the invention. Also recorded is the fact that the actual geometry of the condenser, its size and its type of erection are of no importance in the present connection and that the shape of the tube plates, whether round or polygonal, does not affect the mode of operation of the invention either. All this leads to the fact that the explanation of the invention can take place by means of a simple diagrammatic sketch showing a header.

DESCRIPTION OF THE PREFERRED EMBODIMENT

In the condenser design, both the condenser casing 1 and the header wall 2 consist of simple C-steel. They are each provided with a welded-on flange 1' or 2' respectively, between which the titanium tube plate is firmly bolted by means of the bolting arrangement 10. Particularly if sea water is used as the coolant, the wall 2 is completely provided on the water side with a protective coating 3 which, generally speaking, is a rubber layer but can also be a glass-fibre reinforced epoxy resin coating. On the water side, the protective coating 3 is also included into the flange 2'.

The tube plate 4 consists of pure titanium. It is equipped with a multiplicity of titanium tubes 5 whose ends can be rolled in, welded in or both. By means of these tubes, which form the actual cooling surface and penetrate the steam space 6 over their complete length and are supported in support plates (not shown), the fresh cooling water is conveyed from the first header 7 into the second, opposite header (not shown). In the steam space 6, the steam to be condensed flows in cross-flow around the tubes.

Explosion-bonded titanium plating 8 is located on the flange 1' on the side facing towards the steam space 6. Explosion plating, or also explosion welding, involves a method by means of which various combinations can be produced which are not possible by fusion welding. The titanium sheet is placed over and at a small distance from the flange 1' to be coated. The explosive distributed on the titanium sheet is ignited on one side, whereupon the detonation zone propagates at high speed across the titanium and accelerates the latter onto the flange. Very high pressures then occur in the collision zone and these lead to fluid metal boundary layers and, therefore, to large-area welding.

After the fitting of the tube plates to the condenser casing, the plating 8 is completely sealed by means of a weld seam 9. The steam space 6 is secured by this means against air penetration. However, even in the case of a leaking weld seam 9, precautions are taken against the previously possible penetration of cooling water—which could emerge from the header 7 as a consequence of a leaking protective coating 3 and penetrate into the steam space 6 via the holes 11 and a leaking weld seam 9. These precautions may be seen in the selection of the shape of the flanges 1' and 2'. These are conceived in such a way that the bolting arrangements 10, and hence the through holes 11 in the tube plate 4, are located outside the actual sealing surface between flange 1' and tube plate 4. It is therefore clear that the sealing location, indicated by X in the drawing, between tube plate 4 and flange 1' is directly accessible to inspection and, in fact, independent of whether an annular flange (in the case of circular condensers) or plate flanges (in the case of rectangular condensers) are involved at the flange 1'. If, during such an inspection, it is found that the weld seam 9 is actually leaking and that air penetration into the steam space is occurring in consequence, the position indicated by X can be sealed in the simplest manner over the necessary length or completely with, for example, liquid silicone rubber.

I claim:

1. A condenser comprising titanium tubes attached to titanium tube plates at either end of the tubes, with a steel condenser casing surrounding the tubes and disposed between the tube plates, and header casings at either end of the condenser on the sides of the tube plates opposite the condenser casing, said condenser and header casings being provided with respective flanges by which they are bolted to the tube plates, the flanges of the condenser casing being provided with explosion-bonded titanium plating at a location adjacent to the tube plates, the titanium plating being welded in a watertight manner to the tube plates on the condenser casing side, wherein the bolting arrangement by which the casings and tube plates are attached is located outside the surfaces where the respective flanges of the condenser and header casings are joined to the tube plates.

* * * * *